United States Patent [19]

Izumi

[11] Patent Number: 4,668,845

[45] Date of Patent: May 26, 1987

[54] MODULAR LAMP SOCKET AND SWITCH DEVICE

[76] Inventor: John Izumi, 22 W. 317 Glen Valley Dr., Glen Ellyn, Ill. 60137

[21] Appl. No.: 689,705

[22] Filed: Jan. 8, 1985

[51] Int. Cl.[4] ..... H01R 21/00; H01R 33/00

[52] U.S. Cl. ..... 200/51 R; 200/275; 200/153 W; 200/51.14; 200/51.15; 200/51.16; 200/51.17; 200/51.05; 200/63 R

[58] Field of Search ..... 200/63 R, 63 A, 65, 200/66, 51.02–51.08, 51.14, 51.17, 155 R, 275, 51 R, 153 W

[56] References Cited

U.S. PATENT DOCUMENTS

| | | | |
|---|---|---|---|
| 440,845 | 11/1890 | Herrick | 200/63 R |
| 761,563 | 5/1904 | Wagner | 200/63 R |
| 1,963,784 | 7/1934 | Utrecht | 200/51.04 |
| 2,113,218 | 4/1938 | Nielsen | 200/51.06 |
| 2,654,006 | 9/1953 | Schafer | 200/51.04 |
| 2,799,743 | 7/1957 | Popp | 200/51.03 |
| 2,810,029 | 10/1957 | Hutt | 200/63 R |
| 3,004,119 | 10/1961 | Gerrie | 200/51.14 |
| 3,363,070 | 1/1968 | Kussy | 200/51.17 |

FOREIGN PATENT DOCUMENTS

| | | | |
|---|---|---|---|
| 480441 | 1/1952 | Canada | 200/51.17 |

*Primary Examiner*—Stephen Marcus
*Assistant Examiner*—Ernest G. Cusick

[57] ABSTRACT

A modular lamp socket and switch device with fixed switch contacts formed in a ratchet face, and movable contacts in a matching ratchet face cam driven in a snap-acting manner. A turn-knob or a push or pull-type switch assembly provides the cam drive action. Either a one-way or a three-way lamp socket device may be constructed for a turn-knob, push-knob, or pull-chain type using essentially the same components.

5 Claims, 11 Drawing Figures

MODULAR LAMP SOCKET AND SWITCH DEVICE

This invention relates to electrical lamp apparatus and in particular to improvements in lamp sockets.

BACKGROUND OF THE INVENTION

Electrical lamp sockets having switches can be classified into either one of three separate type devices: (1) A turn-knob type where actuation of the switch is provided by rotating a knob coupled into a switch assembly; or (2) a push-knob type where actuation of the switch is provided by pushing a knob; or (3) a pull-chain type where actuation of the switch is provided by pulling a chain interconnected into the switch assembly. Each lamp socket and switch type is a separate and distinct device each requiring different components—normally between 21 to 30 components. Consequently, a manufacturer of more than one of the switch actuator type light sockets must stock many different components which are not compatible with each other. Accordingly, such a manufacturer does not have the ability to reduce his manufacturing parts inventory and cut costs by having the majority of parts of the several switch actuator types being the same.

The above discussion of the prior art is with regard to one-way or the normal on/off single filament or single wattage type lamp socket. In addition, another type of lamp socket currently available is a three-way socket to accommodate multiple filament or multiple wattage lamps. Typically, a turn-knob or a pull-chain type switch actuator is consecutively operated to switch on progressively higher lamp wattages. In general, such three-way lamp socket component parts are not compatible with those of the one-way type. In addition, they are generally only available in the turn-knob or pull-chain type—and the components of each of these currently available three-way lamp sockets are not compatible with each other.

Thus, a lamp socket manufacturer of conventional pull-chain type, push-knob type, turn-knob type, one-way and three-way types, must stock a considerable amount of manufacturing parts and does not have the ability to intermix parts of one type with parts of the other type in order to reduce manufacturing costs and manufacturing time. Further, all of the above-mentioned prior art types of lamp sockets contain in most cases, separate components which must be welded or riveted together, and also require additional welding, riveting or screw connections in order to assemble the various components.

It is therefore desired to provide a modular lamp socket and switch device having a few parts requiring no welding, riveting or screw connections, and wherein essentially all of the parts can be used to make up a turn-knob, push-knob, pull-chain, one-way or three-way type switch for all three types of actuated lamp sockets.

SUMMARY OF THE INVENTION

In accordance with the principles of the present invention, there is provided a modular lamp socket and switch device and with a switch contact module having fixed contacts formed in a ratchet face selectively engaged by a movable contact in the form of a floating cam. The movable contact, floating cam includes conductive portions formed in a ratchet face for selectively engaging the fixed contacts in a snap-acting cammed manner upon rotation by a cam drive member. The movable cam contacts interconnect one or more of the fixed contacts upon rotation of the cam drive member thus corresponding to an off, single lamp on, or consecutive multiple wattage lamp operation.

The improved lamp socket further includes a turn-knob, and a push or pull-type switch assembly each of which can be respectively connected to the cam drive member to provide the selected lamp structure. In the case of a turn-knob type lamp socket, a ratchet face is provided on the end of the turn-knob to be coupled to the corresponding face on one end of the cam drive member. In the push/pull switch type structure, a spring loaded ratchet disc engages the corresponding face on the cam drive member and is in turn driven by an elongated helix which is either rotated by pushing against the spring or pulling against the spring.

In a one-way switch embodiment, only two fixed contacts are required. In a three-way lamp socket structure, three fixed contacts are required with at least two being interconnected for lamp operation and all three being interconnected for consecutive multiple wattage operation.

Thus, the present invention provides a modular lamp socket and switch assembly capable of use as a pull-chain, turn-knob, push-knob or standard socket without a switch. An additional contact permits use as a three-way socket. Further, the new device permits all of the above operations with only approximately fourteen components as compared to twenty one to thirty components for the separate devices of the prior art. The improved lamp socket with prongs may be plugged into a lamp stem connector. Alternatively, a recepticle or conventional screw terminals may be provided on the lamp socket.

BRIEF DESCRIPTION OF THE DRAWINGS

The features of this invention which are believed to be novel are set forth with particularity in the appended claims. The invention may be best understood by reference to the following description taken in conjunction with the accompanying drawings, in which like reference numerals identify like elements in the several figures and in which:

DETAILED DESCRIPTION

Figures 1, 2:
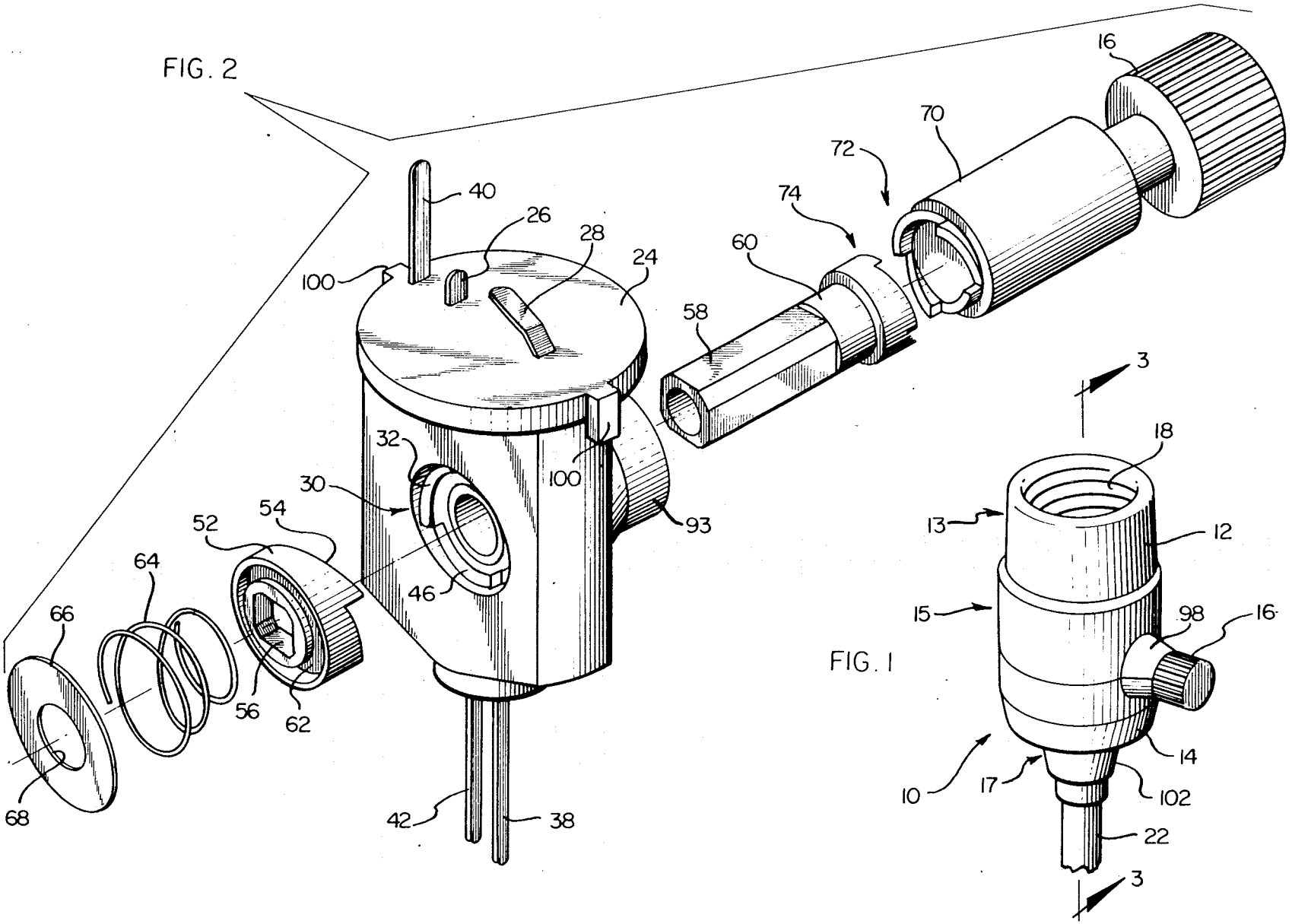
FIG. 1 is a perspective view of a modular lamp socket and switch device in accordance with the present invention.
FIG. 2 is an exploded view illustrating a switch module with fixed contacts operating with a movable floating contact cam and cam drive unit in a turn-knob type switch device.
Figure 3:
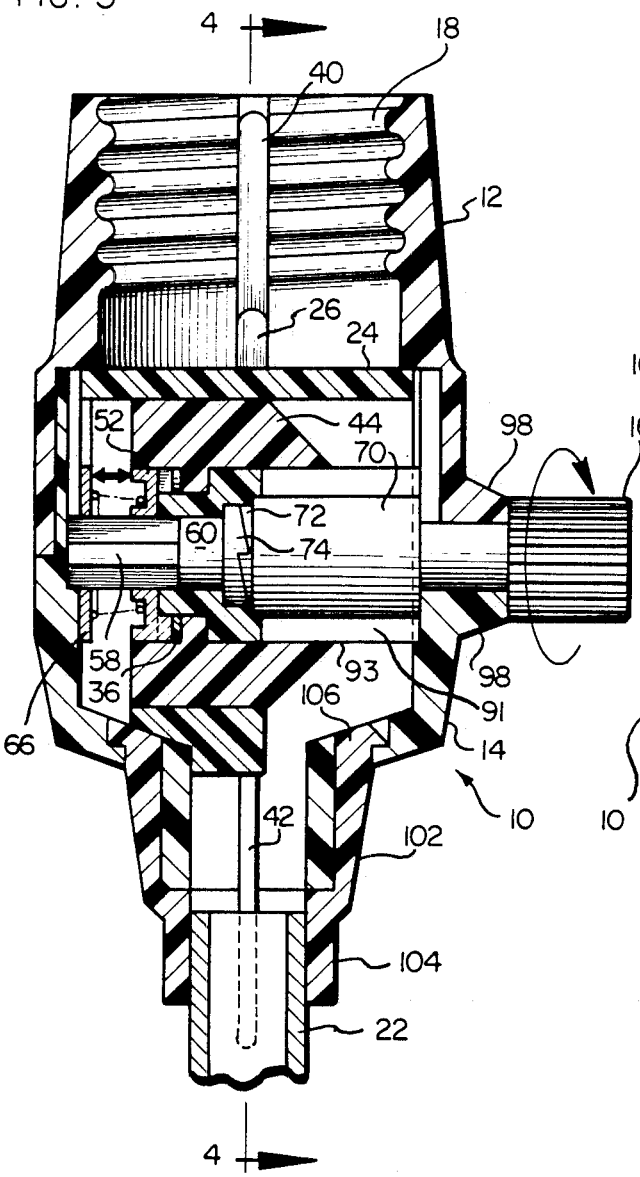
FIG. 3 is a sectional view taken along section line 3—3 of FIG. 1 of the lamp socket and turn-knob type switch.
Figure 4:
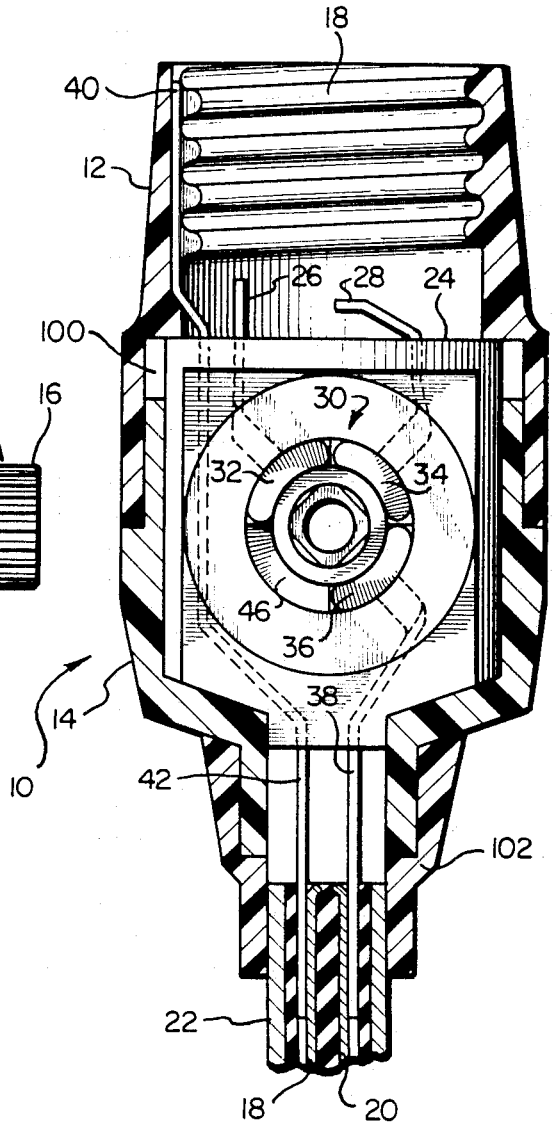
FIG. 4 is a sectional view taken along section line 4—4 of FIG. 3 and illustrating the fixed contacts in the switch module for a three-way switch device.
Figure 5:
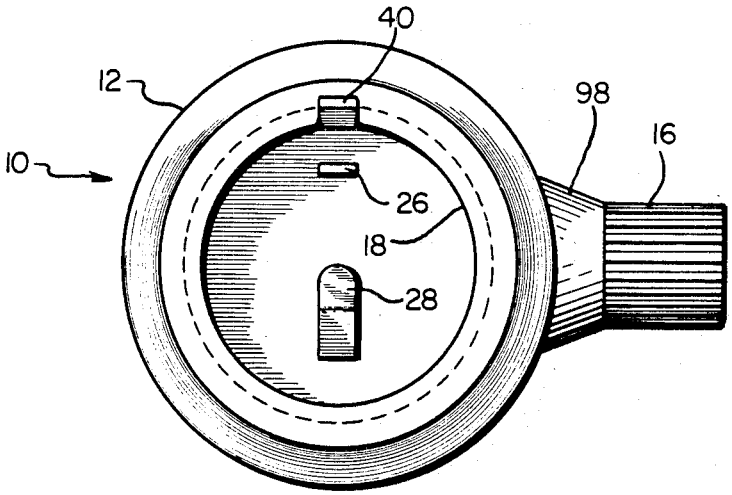
FIG. 5 is a plan view of the turn-knob, three-way switch embodiment.

Referrring to FIG. 1, there is illustrated a modular lamp socket and switch device 10 having unique features in that a substantial portion of the components thereof can be utilized to form a lamp socket with a turn-knob type switch, a push-knob type switch, or a pull-chain type switch and either as a one-way lamp socket or a three-way lamp socket. FIG. 1 illustrates a turn-knob type lamp socket in accordance with the present invention. With reference to FIGS. 1, 3 and 4, socket device 10 includes an upper shell member 12 and a lower shell member 14, both formed of insulating material, and having a turn-knob 16 also of insulating material therebetween. Upper shell 12 includes a lamp bulb mounting end 13 with internal threads 18 for threadable mounting of a lamp in a standard manner. An intermediate switch portion 15 is formed at the overlapping junction of shell members 12. 14. The bottom socket plug end 17 of socket device 10 is plug-mounted into lamp recepticle connector terminals 18, 20 in lamp stem 22 as shown in FIG. 4. Alternatively, conventional screw terminals or recepticles may be provided to connect the lamp wiring to the lamp socket.

Referring now to FIG. 2, there is illustrated the switch components for the turn-knob lamp socket with shell members 12 and 14 removed for convenience of illustration. By simply replacing turn-knob 16 with a push knob and pull-chain type actuator, the same switch components can be used to provide a push-knob and a pull-chain lamp socket. The embodiment shown in FIGS. 1–6 illustrates a three-way lamp socket so that a switch module 24 includes terminals 26, 28 for respective connection to the lamp terminals of a multiple filament or multiple wattage lamp bulb. Switch module 24 includes a fixed contact portion 30 with contacts 32, 34 each of which is formed integrally, respectively with corresponding terminals 26, 28. Fixed contact 36 is similarly mounted at fixed contact portion 30 and is integrally formed with plug prong 38. Switch module 24 further includes an elongated conductor extending outwardly at the top of switch module 24 to form a terminal 40 and extending downwardly below the switch module to form a plug prong 42. Conventional screw terminals or a recepticle, instead of plug prongs 38 and 42 could be used to connect the lamp socket to the lamp wiring. It is understood that plug prongs 38, 42 may be polarized if desired to conform to electrical standards.

Figure 6:
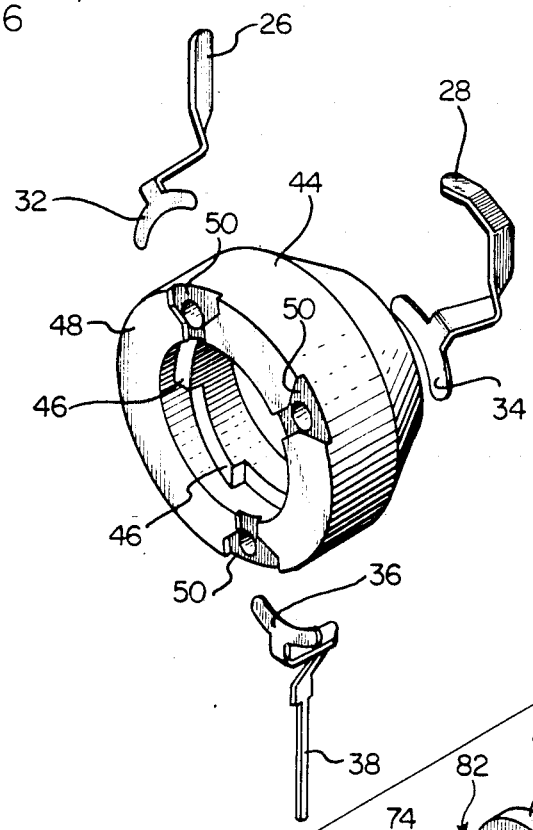
FIG. 6 is an exploded, perspective view of the fixed contact portion of the switch module for a three-way switch device.

A fixed contact base 44 of insulating material is provided in switch module 24 for mounting the three fixed contacts 32, 34, 36. With reference to FIG. 6, fixed contact base 44 includes an inner circular portion with four interconnected steps 46 and with an outer rim 48 having three shaped cut-outs 50 aligned approximately in the middle of three of these steps. The fixed contacts are then placed over the respective cut-out portion to enable a respective fixed contact to rest on a corresponding step and thereby provide a ratchet face. FIG. 4 illustrates the mounting position of the respective fixed contacts resting on respective steps 46 in non-conductive base 44, and the manner in which the fixed contact bent portions (see FIG. 6) are positioned around base 44 to end in respective terminals 26, 28 at the top and in plug prong end 38 at the bottom. The fixed contacts, base 44 and the elongated conductor are then molded to form switch module 24.

Fixed contacts 32, 34, 36 are selectively engaged by a disc-shaped movable contact cam 52 formed of conductive material, such as brass, and having a respective disc face on opposite sides, with one face on a first side formed as a ratchet with three steps 54 (see FIG. 9) each of which matches step 46 at the fixed contact portion 30 of switch module 24. Movable contact 52 has a central cut-out portion with inner perimeter 56 having a cross section matching but slightly larger than outer shaft perimeter 58 of a cam drive member 60. Shaft 58 is inserted through fixed contact portion 30 of the switch module to enable movable contact cam 52 to be mounted onto the shaft. A second side of contact cam 52 includes an annular recess 62 formed on the second side and permitting one end of spring 64 to be seated therein and the other spring end to be resiliently seated against a locking seat 66 having an inner diameter 68 press fitted onto shaft 58. Thus, in the assembled position of FIG. 3, for instance, movable contact cam 52 is spring loaded so that it can slide axially away from and towards fixed contacts on shaft 58 as the shaft is rotated in a clockwise direction as illustrated by the arrows in FIG. 3.

Thus, the three steps 54 on movable contact cam 52 contact and ride on a corresponding three steps formed by fixed contacts clockwise desired snap switching action is provided by the cam action between the contacts as the movable steps ride up or are cammed along the fixed contact steps and drop into their next switch position. Since there are only three steps 54 on the movable contact face, rotation of the movable cam 52 may provide the following lamp switch actions in the illustrated three-way switch device: (1) movable contact 52 contacts non-conductive step 46 and fixed contacts 32, 34 so that fixed contacts 32, 34 are interconnected through movable contact 52 which corresponds to an off condition; (2) rotating movable contact 52 to the next snap cam action position so it contacts fixed contact 32, step 46, and fixed contact 36 interconnects fixed contacts 32 and 36 which corresponds to turning on the lamp with a low wattage or single filament; (3) rotating movable contact 52 to the next cam position so it contacts step 46, fixed contact 36 and fixed contact 34 interconnects fixed contacts 36 and 34 which corresponds to turning on the lamp with a medium wattage condition; and (4) rotating the movable contact cam so that it connects the contact 36, contact 34, and contact 32 corresponds to turning on the highest wattage condition in a multiple filament lamp.

In a one-way lamp socket embodiment, contact 32 and the associated terminal 26 would not be present. Thus, in the one-way embodiment, contact 52 when rotated would be connecting fixed contacts 34, 36 to turn on the lamp and in any other stepped cam position the lamp would be off.

In the illustrated turn-knob embodiment of FIGS. 1–6, knob 16 is formed of insulating material and includes one end which can be gripped for rotation. Knob 16 includes an extended member 70 ending in a cam ratchet face 72 having four step-like ratchet members which match a ratchet face 74 provided on cam drive member 60. Thus, as shown in FIG. 3, the ratchet faces 72, 74 mate together so that as knob 16 is rotated, shaft 58 is cam driven so as to also rotate movable contact 52 which is mounted thereon. In this turn-knob embodiment of FIGS. 1–6, knob 16, extended member 70, and ratchet face 72 form a "drive means" to rotate cam drive member 60. This provides the desired snap, step-like switch camming action previously described.

Figure 7:
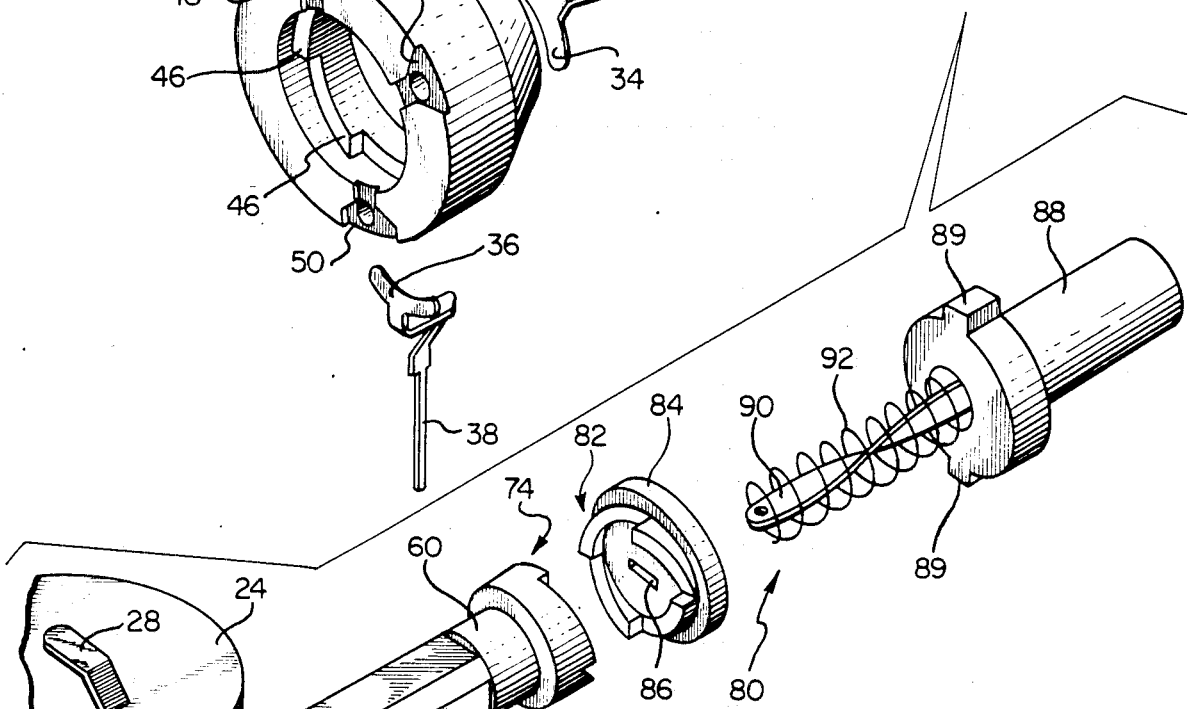
FIG. 7 is a fragmentary, exploded view illustrating a lamp socket and push-knob type switch embodiment, the remaining components being as illustrated in FIG. 2.
Figure 7:
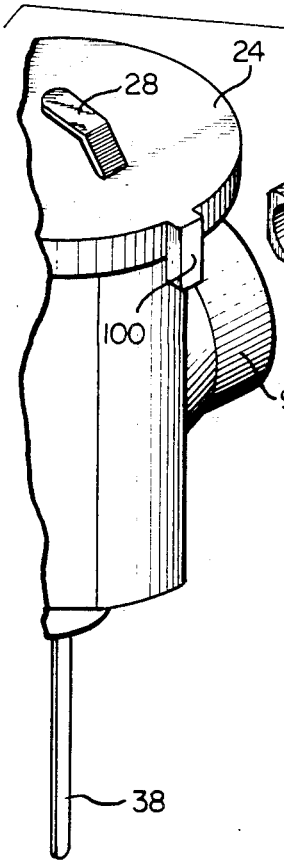
Figure 8:
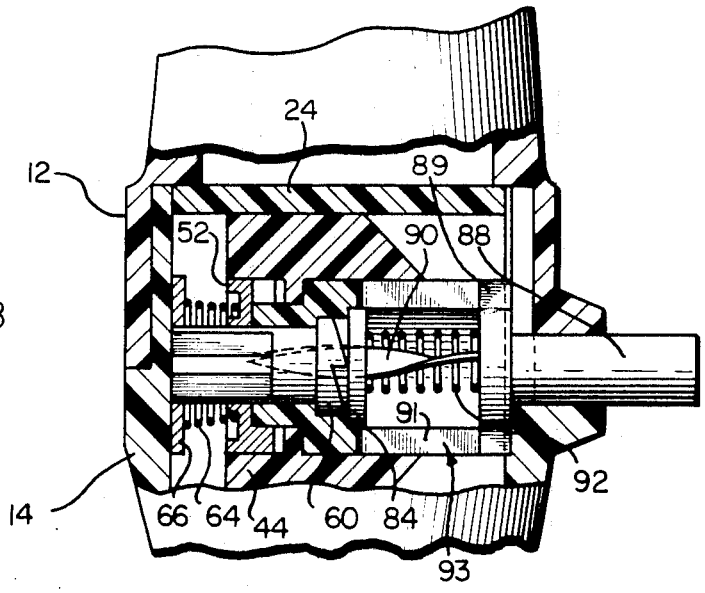
FIG. 8 is an elevational view, partly fragmented of the lamp socket push-knob type embodiment illustrating the linearly moved helix which eventually rotates the movable, floating contact cam.

Referring now to FIGS. 7 and 8, there is illustrated a push-knob type embodiment of the invention in which the components are essentially the same as in the previously illustrated turn-knob embodiment with the exception of the replacement of turn-knob 16 with a push-knob assembly 80. In this embodiment, a ratchet face 82 identical to ratchet face 72 and thus matching ratchet face 74 on cam drive member 60 is provided on a disc 84 with a longitudinal slot 86. Push knob 88 includes an elongated helical member 90 fixed at one end of knob 88 and extending from the opposite end as shown in FIG. 8. Spring 92 is coiled around the helical member with one end resting against knob 88 and the other end against disc 84 so that when the components are assembled as shown in FIG. 8, the helical member extends through slot 86 in disc 84 and knob 88 is spring loaded outwardly away from the disc. Thus, in this embodiment, pushing knob 88 towards disc 84 rotates disc 84 as it slides on helical member 90 linearly moving and passing through slot 86, which in turn rotates cam drive member 60 through the matching ratchet faces 74, 82. Note tabs 89 on knob 88 are slidably captured in slot 91 of a tubular extension 93 of switch module 24. In this push-knob embodiment of FIGS. 7 and 8, disc 84, knob 88, helical member 90, and spring 92 form a "drive means" to rotate cam drive member 60.

Figures 9, 10, 11:
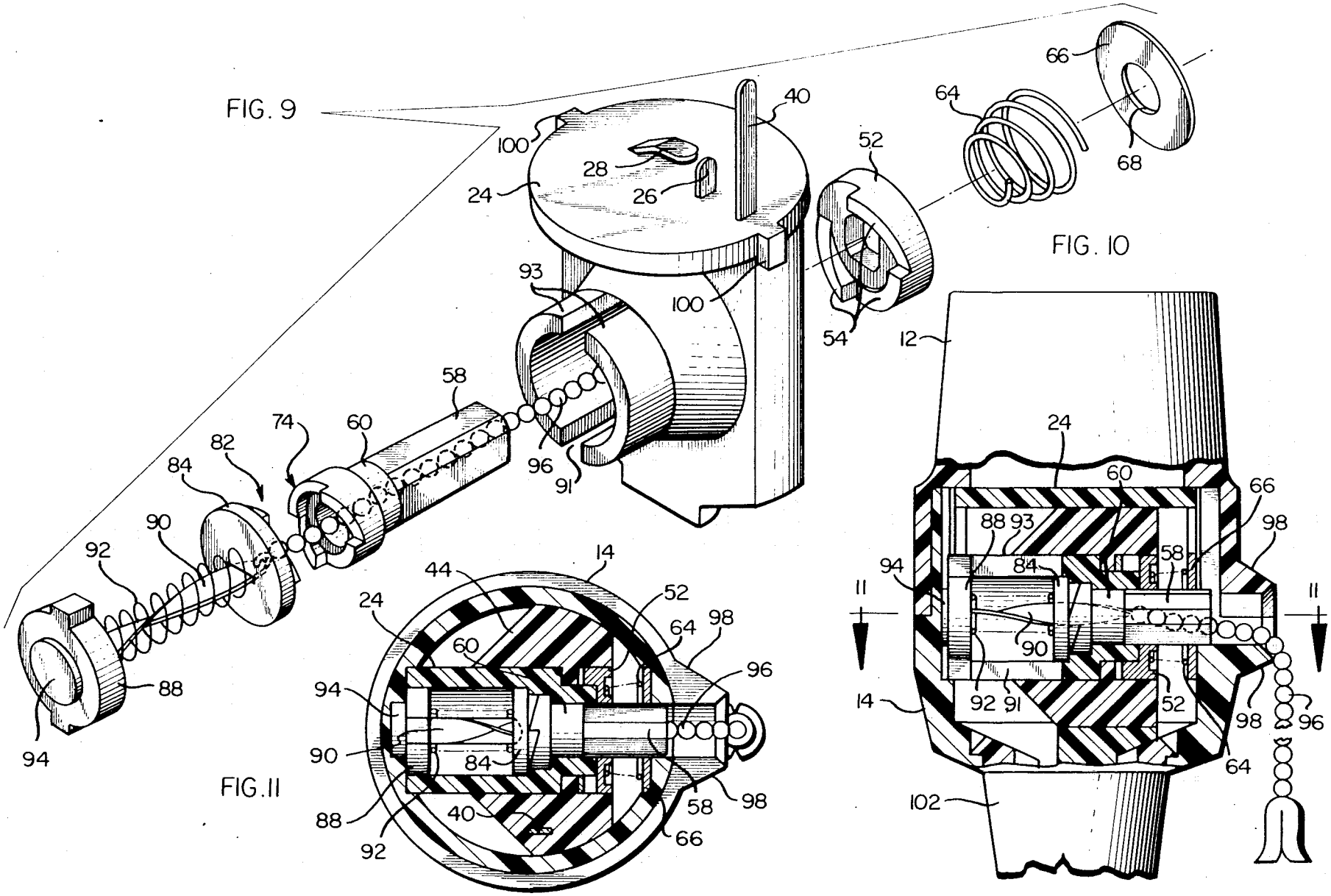
FIG. 9 is an exploded view of a pull-chain type switch embodiment with the components and operation being similar to that of the push-knob type embodiment of FIG. 7.
FIG. 10 is an elevational view, partly fragmented of the assembled pull-chain type embodiment.
FIG. 11 is a sectional view taken along section line 11—11 of an assembled pull-chain type switch embodiment.

In FIGS. 9–11, there is illustrated a pull-chain type lamp socket using the same components as in the previously described push-knob type embodiment, except that the shaft on knob 88 has been shortened as illustrated by the shaft 94 in FIG. 9. In addition, when the unit is assembled, switch module 24 is rotated 180° when inserted into outer shell member 14 as compared to the push-knob embodiment of FIGS. 7 and 8. Further, in this instance, a pull-chain 96 is provided with one end attached to helical member 90 and the other end extending through the switch body as shown in FIGS. 10 and 11. In this case pulling the chain linearly moves helical member 90 through slot 86 in disc 84, thereby rotating the disc and cam drive member 60 to provide the desired snap cam switching action of movable contact 52 on the fixed contacts. In this pull-chain embodiment of FIGS. 9–11, elements 84, 88, 90, 92, 96 form a "drive means" to rotate cam drive member 60.

Upper shell 12 and lower shell 14 include matching flange portions 98 which cooperate with a reduced shaft on turn-knob 16 and with the elongated shaft on push-knob 88. Further, various ridges and slots such as protruding ridge 100 and cooperating slots in the shell members are provided to lock the components together. In addition, an intermediate connecting member 102 is provided with one end 104 threadably engaging lamp stem 22 and with the other end 106 snap-mounted at the bottom of shell 14 upon plug mounting of lamp socket 10 into connectors 18 and 20.

Therefore, the present invention provides a unique lamp socket in which essentially the same components can be used to make a turn-knob, push-knob or pull-chain type lamp socket in either a one-way or three-way embodiment and without requiring welding, riveting or screw connections.

The foregoing detailed description has been given for clearness of understanding only, and no unnecessary limitations should be understood therefrom, as modifications will be obvious to those skilled in the art.

What is claimed is:

1. A modular lamp socket and switch device adaptable for selective use as push-button, pull-chain or turn-knob switch actuation and pluggable into lamp stem recepticle connector terminals, said device comprising:

an outer shell forming a lamp socket having a lamp bulb mounting end, a socket plug end, and an intermediate switch portion;

a switch contact module including an insulative body having a switch contact mounting position intermediate opposite module ends, a pair of fixed conductive contacts mounted to form a ratchet face at the switch contact mounting position and with the fixed contacts insulated from each other, and an elongated conductor in the insulative body, one of the fixed contacts and one end of the elongated conductor extending from one module end to form respective terminals and the other of the fixed contacts and the other end of the elongated conductor extending from the other module end to form respective plug prongs;

means for mounting the switch contact module in the outer shell with the terminals at the lamp bulb mounting end, the plug prongs at the socket plug end, and the switch contact mounting portion aligned with the outer shell switch portion;

a disc-shaped movable contact with a respective disc face on each of two opposite sides of the movable contact, including a conductive cam contact portion on one of the disc faces on one side of the movable contact adapted so as to be capable of extending across the pair of fixed contacts;

a cam drive member including a shaft insertable into the outer shell switch portion and into the switch contact mounting position for rotatable movement with respect to the switch contact module;

means for mounting the disc-shaped movable contact to the cam drive member shaft with the disc faces at right angles to the cam drive member shaft and so as to enable rotation of the conductive cam contact portion with respect to the pair of fixed contacts;

said disc-shaped movable contact mounted on the cam drive member shaft with said one disc-face and the conductive cam contact portion thereon facing said ratchet face formed by said pair of fixed contacts; and drive means engageably coupled to the cam drive member for rotating the cam drive member and thereby rotating the position of the conductive cam contact portion of the disc-shaped movable contact on the ratchet face formed by said pair of fixed contacts, said one disc-face and the conductive cam contact portion thereon always facing said ratchet face formed by said pair of fixed contacts during rotation of the cam drive member.

2. A modular lamp socket and switch device according to claim 1, wherein the drive means comprises a turn knob having a cam end and a knob end, the turn knob cam end insertable into the outer shell switch portion and into the switch contact module mounting position to engageably couple the cam drive member to enable rotation of the cam drive member by rotating the turn-knob end.

3. A modular lamp socket and switch assembly according to claim 1, wherein the drive means comprises a push-button/pull-chain assembly including a cam disc with a ratchet face on one disc end, a button member, an elongated helical member with one end rotatably mounted in the button and the other end passing through the cam disc, and spring means for spring loading the cam disc with respect to the button, the assembly insertable into the outer shell switch portion and into the switch contact module mounting position to engageably couple the ratchet face and the cam drive member to enable rotation of the cam drive member by linear movement of the button.

4. A modular lamp socket and switch device according to claim 1 for use with a multiple wattage lamp, wherein said switch contact module includes a third fixed contact mounted at the switch contact mounting position and extending from the one module end to form a respective terminal at the outer shell lamp mounting end and the movable contact conductive cam contact portion is adapted to extend across the three fixed contacts, whereby the cam contact portion selectively conductively interconnects the fixed contact plug prong with none, either one, or both of the fixed contact terminals corresponding to selective operation of the multiple wattage lamp.

5. A modular lamp socket and switch device adaptable for selective use as push-button, pull-chain or turn-knob switch actuation and pluggable into lamp stem recepticle connector terminals, said device comprising:

an outer shell forming a lamp socket having a lamp bulb mounting end, a socket plug end, and an intermediate switch portion;

a switch contact module including an insulative body having a switch contact mounting position intermediate opposite module ends, a pair of fixed conductive contacts mounted at the switch contact mounting position with the fixed contacts insulated from each other and formed to present a first ratchet face, and an elongated conductor in the insulative body, one of the fixed contacts and one end of the elongated conductor extending from one module end to form respective upper terminals and the other of the fixed contacts and the other end of the elongated conductor extending from the other module end to form respective plug prongs;

means for mounting the switch contact module in the outer shell with the upper terminals at the lamp bulb mounting end, the plug prongs at the socket plug end, and the switch contact mounting portion aligned with the outer shell switch portion;

a disc-shaped member having a conductive cam contact portion formed to present a second ratchet face matching the fixed contacts first ratchet face and adapted so as to be capable of extending across the pair of fixed contacts;

a cam drive member including a shaft insertable into the outer shell switch portion and into the switch contact mounting position for rotatable movement with respect to the switch contact module;

means for mounting the disc-shaped member to the cam drive member shaft so as to enable rotation of the conductive cam contact portion with respect to the pair of fixed contacts;

said disc-shaped member mounted on the cam drive member shaft with said second ratchet face perpendicular to the cam drive member shaft and oppositely facing said first ratchet face; and drive means engageably coupled to the cam drive member for rotating the cam drive member and thereby rotating the position of the conductive cam contact portion of the disc-shaped member on the fixed contacts in a snap-acting manner, said first and second ratchet faces always oppositely facing each other during rotation of the cam drive member.

* * * * *